United States Patent [19]

Dunstan

[11] 4,045,071

[45] Aug. 30, 1977

[54] SYSTEM FOR TRANSPORTING AND STORING LONG EXTRUSIONS

[75] Inventor: James W. Dunstan, Kalamazoo, Mich.

[73] Assignee: Acorn Building Components, Inc., Detroit, Mich.

[21] Appl. No.: 640,127

[22] Filed: Jan. 5, 1976

[51] Int. Cl.[2] ..... B66C 1/18

[52] U.S. Cl. ..... 294/67 R; 214/8; 214/621; 294/81 SF

[58] Field of Search ..... 214/10.5 R, 8, 621; 294/815 F, 815 R, 67 R, 67 DA

[56] References Cited

U.S. PATENT DOCUMENTS

| | | | |
|---|---|---|---|
| 3,173,556 | 3/1965 | Gaudriot et al. | 294/81 SF |
| 3,261,637 | 7/1966 | Bopp et al. | 294/81 SF |
| 3,514,146 | 5/1970 | Zweifel et al. | 294/81 SF |
| 3,537,599 | 11/1970 | Jay | 214/10.5 R |
| 3,559,812 | 2/1971 | Wolf et al. | 214/10.5 R |
| 3,727,965 | 4/1973 | Cranston et al. | 294/67 R |

*Primary Examiner*—Robert J. Spar
*Assistant Examiner*—Ross Weaver
*Attorney, Agent, or Firm*—Cullen, Settle, Sloman & Cantor

[57] ABSTRACT

A system for transporting and storing long extrusions including a rack upon which a bundle of extrusions is stacked and a pick-up unit which engages the rack so that the stacked bundle of extrusions may be lifted. The rack includes a pair of spaced apart U-shaped frames each having a base and upwardly extending legs for receiving a stacked bundle of elongated extrusions. Each leg is formed of an outwardly opening channel whose base is provided with a vertically elongated slot near its upper end and with pins arranged within and extending transversely of the channel, one at the lower end of the slot and one at the upper end of the slot. Strapping is engaged around the lower pins and extended through the slots to span the space between the pair of legs of the frame to engage the upper portion of the bundle for securing the bundle within the frame. The upper ends of the legs of one frame telescopically fit into the base of a frame located above it for forming stacks of racked bundles. The pair of frames, together with their bundle, is lifted by engaging the upper pins with a lifting hoist or pick-up unit. The pick-up unit includes a plurality of elongated hollow beams telescoped together to form a composite beam assembly of adjustable working length and a pair of yokes, one mounted on each end of the composite beam assembly. An arm is pivotally mounted on each end of each yoke and the arms are biased or counterbalanced to pivot out of engagement with the rack pins. A pivotally mounted locking lever is associated with each arm and pivoting the lever overcomes the bias of each arm by a camming or abutting contact therewith to engage the arm with the upper rack pin to lock the pick-up unit arms to the rack. A spring-loaded safety bolt engages an aperture in the arm to further lock the arm in a rack engaging position.

12 Claims, 12 Drawing Figures

SYSTEM FOR TRANSPORTING AND STORING LONG EXTRUSIONS

BACKGROUND OF INVENTION

In the manufacture of extrusions, as for example aluminum extrusions used as window frame components or the like, it is conventional to cut the long extrusions received from the extrusion equipment into lengths such as ten to fourteen feet, and then to bundle the lengths of extrusions together for shipment to the user of the extrusions, that is, to the fabricator who converts the extrusions into finished goods. Typically, such bundles consist of a large number of extrusions formed into a pile made up of a number of extrusions arranged side by side as well as vertically one above another. The bundles are held together by encircling strapping or bands. Usually, either wood strips or corrugated cardboard strips or both are arranged around the outside of the bundle, between the bundle and the bands, as padding to protect the extrusions from damage from the bands.

In such type of bundling, the long bundles of extrusions tend to be irregular in cross sectional shape and the number of extrusions per bundle may vary. Thus, when the bundles are loaded upon trucks for shipment, they tend to tip over. Where bundles are stacked, one upon another and along side of each other in a truck bed or body, there is considerable difficulty in unloading the truck. Usually, the bundles are handled by using belt-like slings which are manually arranged beneath each bundle and lifted by a suitable hoist. However, the lifting of a bundle out of a truck often causes other bundles to fall over.

The handling of such bundles is not only troublesome and time-consuming, but also presents hazards to the men who are called upon to move, load and unload such bundles on trucks or within a shop. Moreover, a relatively large quantity of cardboard, wood and other padding material used when tying the bundles together is required which results in considerable waste of such materials after the bundles are disassembled for final use of the extrusions in fabricating finished products.

Furthermore, when conventional hoists are used, the variable length of the extrusions and the difficulty in accurately hooking up the belt-like slings at the center of gravity of a bundle causes each bundle to tip precariously as it is being moved by the hoist. While two-point lifting is possible, this requires two belt-like slings to be manually arranged beneath each bundle and thus requires additional hoist apparatus and additional manual labor.

Hence the invention herein relates to an improved system and method for forming, storing and transporting bundles of long extrusion or extrusion-like elements which eliminate many of the handling problems and considerably reduce the cost of handling such type bundles.

SUMMARY OF INVENTION

The invention herein contemplates the use of a pair of U-shaped frames each forming a rack for receiving a bundle formed of a number of long extrusion-like relatively stiff elements such as window frame extrusion components, and a pick-up means for engaging each rack so that the racked bundle may be conveniently transported and stored as a rigid unit.

The extrusion-like components are stacked within a pair of spaced apart frames, which open upwardly, until a predetermined number of components are stacked and so that the top of the bundle is below the upper ends of the legs of the U-shaped frames. Thereafter, the bundle and the frames are secured together by means of extending band-like strapping across the top of the bundle, between the spaced apart legs of each frame, and through vertically elongated slots formed in each of the legs. The strapping is engaged around lower anchor pins formed on the legs at the bottom ends of the slots. Thus, the strapping bands do not totally encircle the extrusions but close the upper ends of the frames at whatever height is required due to the adjustability of the bands through the slots. The racks are so made that the legs of one rack telescopically fit into the rack thereabove it to form stacks of racked bundles of extrusions.

The pick-up unit includes a plurality of elongated hollow beams telescoped together to form a composite beam assembly of adjustable working length to correspond to the longitudinal spacing between the two individual racks associated with one bundle. A yoke is mounted on each end of the composite beam assembly and an arm is pivotally mounted on each end of each yoke. The arms are counterbalanced or biased out of engagement with the rack pins and a locking lever is pivotally mounted on the yoke. Pivoting the locking lever contacts the arm to overcome the bias of the arm and to pivot the arm by a camming action so that the arm engages the anchor pin in the rack. A spring-loaded safety bolt engages a suitable aperture in the arm to lock the arm of the pick-up unit in the rack-engaging position. Then a conventional hoist is used to lift the racked bundle and pick-up unit.

With this contemplated system and method, bundles of extrusions or the like may be quickly made up, easily fastened together with minimum banding material, a pick-up unit easily attached thereto, and the entire racked bundle easily lifted by a hoist. All or most of the previously required padding material which was used to protect the extrusions against the compression of the bands may be eliminated as the bands no longer encircle the entire bundle. In addition, the racks permit regular alignment of the bundles on a truck bed for shipment and on a floor in a warehouse or in a factory. Thus with the present construction, the labor previously required for forming such bundles and for handling such bundles is substantially reduced, the hazard of handling irregular shaped bundles is virtually eliminated and costs are substantially reduced since the racks can be reused. Furthermore, damage to the extrusions in shipping and handling and storage is substantially reduced.

Furthermore, with the use of the pick-up unit of the present invention, a bundle of stacked extrusions can be easily lifted and transported to or from a truck without knocking over adjacent bundles of extrusion-like components. A conventional hoist such as an overhead crane, a hoist suspended from a monorail, or a hook suspended from a lift-truck jib boom, may be utilized to transport and stack the racked bundles.

BRIEF DESCRIPTION OF THE DRAWINGS

These and other objects and advantages of the present invention will become more apparent upon reading the following detailed description taken in conjunction with the drawings.

In the drawings, wherein like reference numerals identify corresponding components.

DETAILED DESCRIPTION OF THE INVENTION

The invention herein relates to the problem of stacking, handling transporting and storing elongated, relatively stiff elements such as long metal or plastic extrusions of different cross sectional shapes used in forming window frame components or the like. By way of example, extrusion-like components 10 are schematically illustrated and are formed into bundles 11 composed of a number of such components arranged one above another as well as one along side another.

Figure 2:
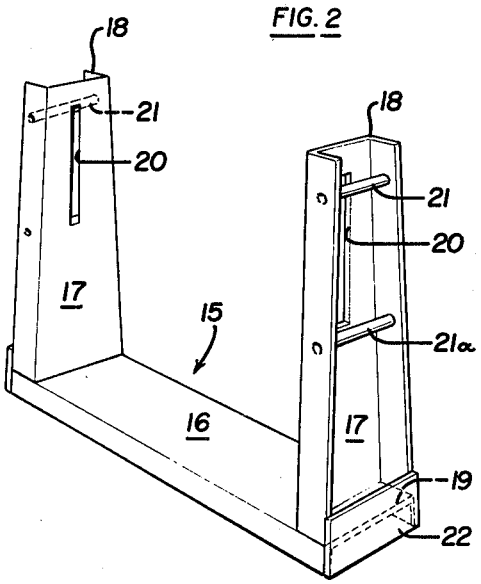
FIG. 2 is a perspective view of a single U-shaped frame rack.
Figure 3:
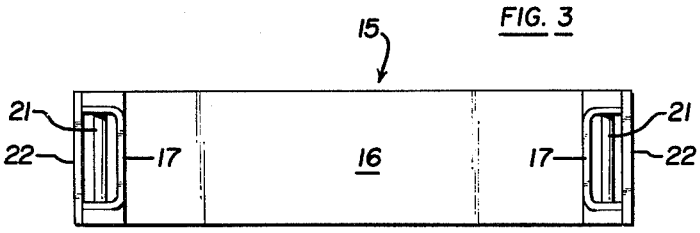
FIG. 3 is a top plan view of the U-shaped frame rack of the present invention.
Figure 5:
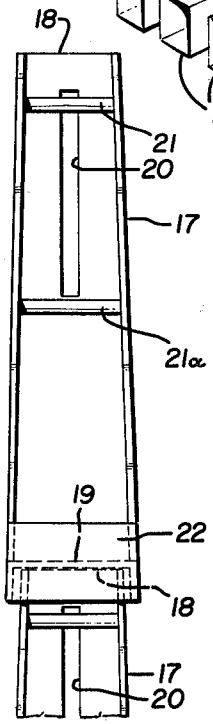
FIG. 5 is a side elevation view of a rack of the present invention with a second rack nested therein.

For stacking and storing such bundles 11 of elongated extrusions and for subsequent transporting, frame-like racks 15 are utilized. Each rack 15 is U-shaped in configuration and is formed of a downwardly opening channel-shaped base 16 upon whose opposite ends a pair of vertically upwardly extending channel-shaped legs 17 are fastened such as by welding or the like. The channel-shaped legs open outwardly and as can be best seen in FIGS. 2 and 5 the legs are tapered from a narrower top 18 to a wider bottom or lower end 19.

These channel-shaped legs 17 may be formed in a suitable press forming or stamping operation and the legs as well as the channel base are preferably made of a strong metal such as sheet steel of suitable gauge to provide rigidity and strength.

Vertically elongated slots 20 are formed in the bases of each of the channel-shaped legs 17 near the upper ends thereof. At the upper end of each slot, a first anchor means in the form of a pin 21 extends transversely of the flanges which make up the channel-shaped leg with the opposite ends of the pin secured to the respective flanges. Below the lower ends of each slot additional anchor means in the form of a pin **21*a* extends transversely of the flanges with the opposite ends of the pin secured to the flanges. Thus pins 21 and 21*a*** form upper and lower anchor means in each channel leg. The pins are steel pins of approximately one-half inch diameter.

The opposite ends of the base-forming channel 16 are closed off with a closure plate 22 which covers not only the open end of the channel but also extends upwardly above the base of the channel to partially close the bottom end 19 of the leg 17. Thus one rack 15 may be stacked upon another rack 15 by inserting and nesting the narrow upper end 18 of the legs 17 of the lower rack into the base 16 of the frame thereabove. The closure plates 22 prevent one rack from sliding sideways or transversely relative to the other rack. The flanges of the base channel 16 prevent one rack from sliding longitudinally relative to the other rack.

Figure 1:
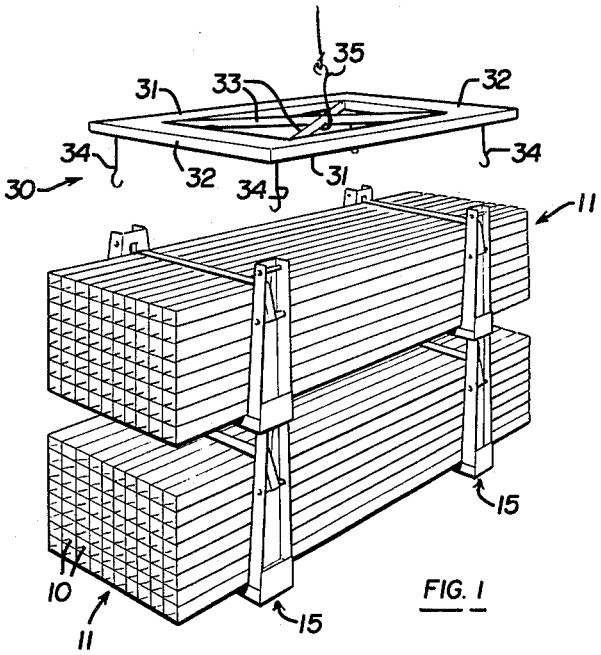
FIG. 1 is a perspective illustration of two stacked bundles of extrusions, each held within racks of the present invention, and with a lifting hoist arranged above them.

In use, a pair of racks 15 are arranged in spaced apart alignment as illustrated in FIG. 1, preferably along side of the cutting machinery which cuts the extrusions into the long lengths. As each extrusion or component is cut, it is placed into the aligned racks until a bundle is built-up. The height of the bundle is below the top 18 of the rack leg 17.

Figure 6:
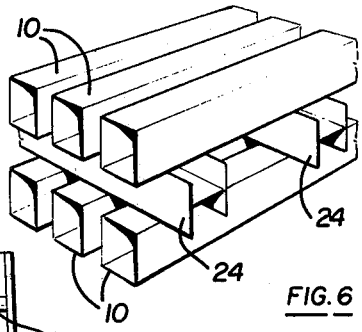
FIG. 6 illustrates schematically the stacking of extrusion-like elements within the rack and with a spacer utilized between rows of extrusions.
Figure 4:
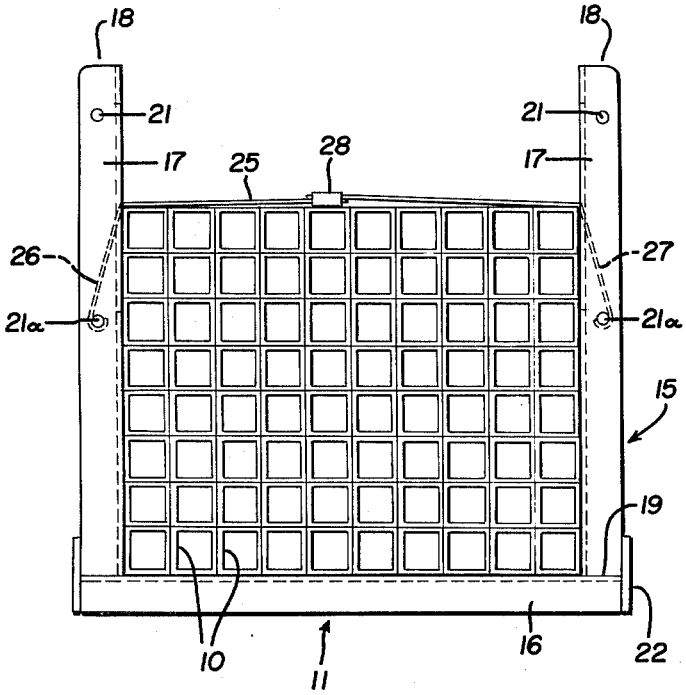
FIG. 4 is a front end view of the rack of the present invention with the extrusion like elements fastened therein.

When it is desired to handle the bundle 11 as a single unit for further heat treating, such as conventional aging of aluminum extrusions, or where it is desired to handle the bundle as a unit for dipping the extrusions into chemical or paint baths, the components 10 are carefully laid into the racks in layers which layers are vertically spaced apart by means of suitable spacers such as H-shaped in cross section spacers 24 which may be formed of plastic extrusions. The components 10 may be also spaced slightly apart in the horizontal direction if desired, as illustrated generally in FIG. 6.

Once the bundle is built up to its full height, which relates generally to the number of extrusions or number of pounds of extrusions loaded into the bundle 11, then strapping bands 25 of conventional plastic or steel strapping are arranged over the top of the bundle and looped as at 26 and 27 around the opposite lower pins **21*a* and then fastened together by a conventional strap fastener buckle or tie 28. Thus, the strapping band 25, pressing down upon the top of the bundle of components, holds the bundle in its desired shape. The same strapping operation is repeated at the other rack of the same bundle. At this point, the entire bundle 11** of extrusions or components is rigidified and may be treated as a single unit.

For lifting the bundle, a pick-up unit or lift hoist 30 is provided. One form of a lift hoist is illustrated in FIG. 1 as being formed of a horizontally arranged frame made of longitudinal strips 31 whose ends are fastened to end strips 32 and to cross bracing strips 33. Elongated elements 34 depend downwardly from each of the corners of the hoist and these depending elements have lower hooks arranged to engage the pin of each rack 15. A lift hook 35 is secured at the center of the frame and extends upwardly for lifting the frame. Thus, the depending hooks engage one of the anchor means or pins to lift the bundle as the hoist 30 is lifted vertically. As the bundles are assembled, they may be stacked one upon another by interengaging the open base channel 16 of one rack with the tops 18 of the legs 17 of the racks immediately therebelow.

Where the components are to be further processed, such as by aging in a conventional furnace, the bundle may be lifted into the furnace as a unit and thereafter removed after treatment. Likewise, it may be further handled as a complete unit in dipping into paint or other chemical baths such as are often required where protective or decorative coatings are to be applied to the components. While the racked bundles may be transported with a hoist such as the hoist shown schematically in FIG. 1, it must be appreciated that the longitudinal strips 31 of the hoist of FIG. 1 are of a fixed length. This provides a limitation on the longitudinal spacing between the two racks 15 of a particular bundle. To overcome this limitation the present invention also contemplates an improved pick-up unit 40 of adjustable working length and one which provides for positive engagement with the anchor means or pins of the racks 15.

Specifically, as illustrated in FIGS. 7 through 12, the preferred pick-up unit 40 includes an elongated composite beam assembly 41 at each end of which a rack engaging unit is attached. The beam assembly includes three square tubular steel beams, a center beam 42 and two extension beams 43, with the extension beams having an outside diameter corresponding to the inside diameter of the center beam 42 and with sufficient clearance for the extension beams to telescopically slide inwardly and outwardly of the center beam 42. A locking screw 44 is threaded through a suitable aperture at each end of the center bean 42 to be in frictional engagement with the extension beam 43. When the locking screws 44 are tightened they frictionally retain the extensions 43 in place so that the composite beam assembly may be adjusted to a desired working length and securely held at such a desired length.

A flat elongated steel bar or plate 45 is welded to the top of the center beam 42 for additional strength and rigidity of the assembly. The steel bar has an aperture 46 therethrough so that the composite beam assembly may be lifted by a hoist suspended from a monorail or from a hook suspended from a lift truck jib boom or the like. The free end of each extension beam 43 is securely mounted to a downwardly opening channel-shaped yoke 50 such as by a locking screw 51 threaded through a suitable aperture at the end of the extension beam 43 and into positive engagement with the yoke 50.

In order to permit the pick-up unit 40 to engage the anchor means of the racks 15, a pair of elongated arms 52 are mounted at the opposite ends of each yoke 50. These arms 52 are welded to an axle or shaft 53 and the axle is journalled in suitable bearing blocks 54 which bearing blocks are welded on the top surface of the yoke 50. Thus the arms 52 are pivotally mounted on the ends of the yoke 50.

Figure 7:
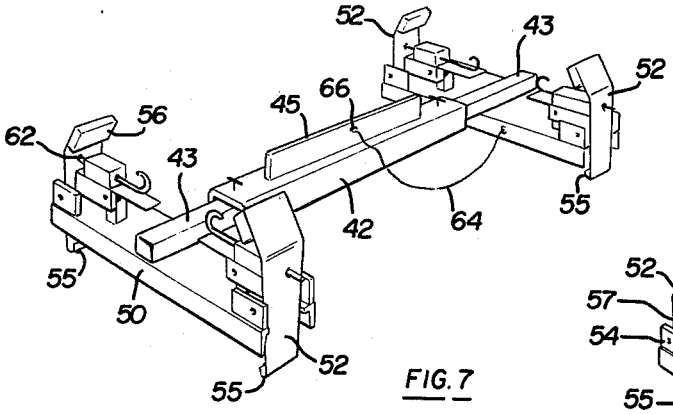
FIG. 7 is a perspective illustration of the pick-up unit of the present invention illustrating the composite beam assembly, the yokes and the counterbalanced arms.
Figure 8:
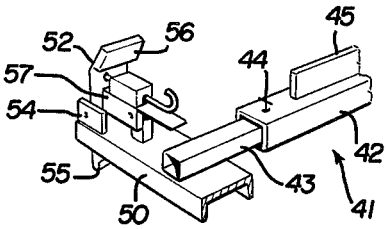
FIG. 8 is an enlarged perspective illustration of the composite beam assembly, yoke and arm of the pick-up unit of the present invention.
Figure 9:
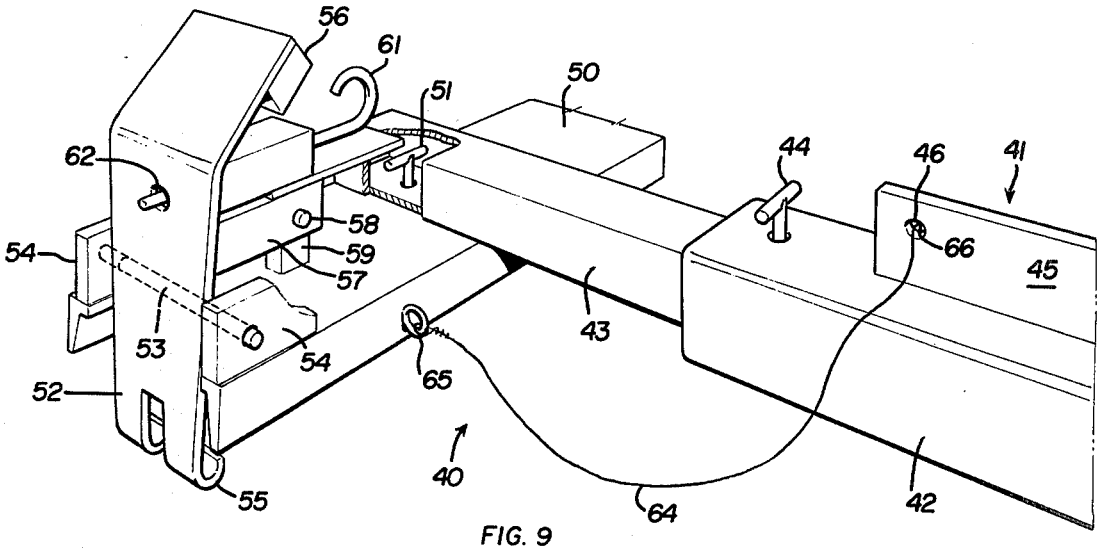
FIG. 9 is an enlarged partial perspective illustration of one end of the pick-up unit of the present invention.
Figure 10:
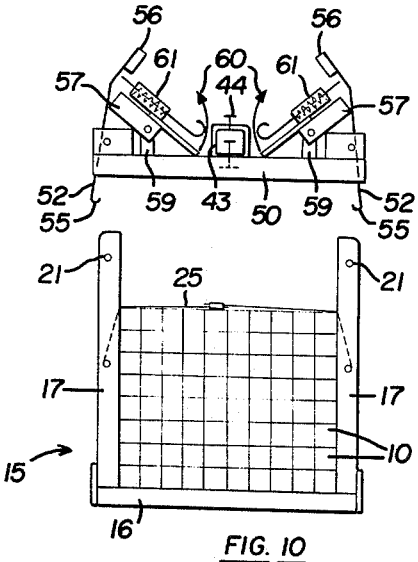
FIG. 10 is a front end view of the pick-up unit of the present invention positioned above a racked bundle prior to the racked bundle being engaged.
Figure 11:
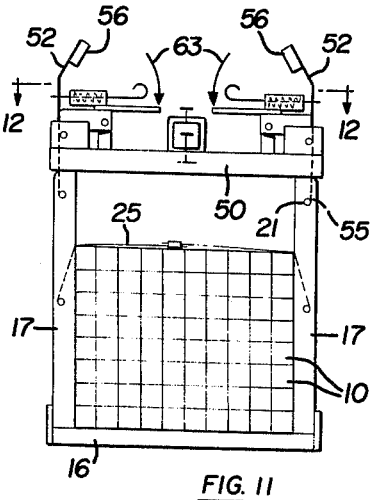
FIG. 11 is a front end view of the pick-up unit of the present invention engaged with a racked bundle of extrusions.
Figure 12:
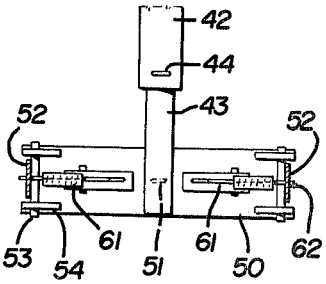
FIG. 12 is a partial top plan view of the pick-up unit of the present invention as seen in the plane of arrows 12—12 of FIG. 11 and with the extrusions omitted for clarity.

The lower end of each arm 52 is tapered inwardly for self aligning in the leg 17 and the lower end of the arm is formed as a hook or finger 55 to engage the pin 21 (FIGS. 7 and 8). The length of the arms is preferably short enough so that the upper anchor pins 21 are engaged by the fingers 55. However, longer arms may be used to engage the lower pins 21*a*, in which instance there are provided a pair of spaced apart fingers 55 with the space therebetween providing a clearance so that the fingers do not entangle with the strapping band 25. The pair of fingers is illustrated in FIG. 9 with the lower end of the arm again being tapered. The upper ends of the arms 52 are curved inwardly and have a counterbalance block 56 welded thereto to bias the top of each arm inwardly and bias the lower ends of each arm and the fingers outwardly. Thus when the pick-up unit 40 is lowered toward a racked bundle, as illustrated generally in FIG. 10, the fingers 55 of the arms are outwardly of the racks and provide sufficient clearance so that the pick-up unit may be lowered until the yoke 50 contacts the tops 18 of the rack legs 17.

Means are provided for pivoting the arms 52 about the axle 53 to engage the fingers 55 with the pins 21 of the racks. Specifically, locking levers 57 are welded to axles 58 and each axle 58 is suitably journalled in a mounting block 59 with each mounting block 59 welded to the top of the yoke 50. The levers 57 extend outwardly a sufficient distance to engage the arms 52 and extend inwardly toward each other to provide access to the operator of the pick-up unit. When it is desired to have the pick-up unit engage the anchor pins 21, the pick-up unit is first lowered until the yoke 50 abuts the top of the rack 15. Then the levers are rotated about their axles 58 in the direction of arrows 60 of FIG. 10. This causes the outer end of each lever 57 to engage or contact the arm 52 and overcome the bias of a counterbalance block 56 to pivot the arm 52 about its axle 53 by a camming action. This permits the fingers 55 to slip under the anchor pins 21 as illustrated generally in FIG. 11. With the pick-up unit in the position of FIG. 11, when the pick-up unit 40 is lifted, the entire racked bundle moves as a rigid unit with the pick-up unit.

To prevent inadvertent disengagement of the pick-up unit arms from the rack, spring-loaded safety bolts 61 are provided on the top of each locking lever 57 and the bolts are biased to extend outwardly through the suitable apertures 62 in each arm 52 when the arm engages the pins 21. Thus when the levers are pivoted in the direction of arrows 60, the spring-biased bolts 61 automatically extend through the apertures 62 in the arms and this is illustrated in greater detail in FIG. 12.

Once the racked bundle has been transported as a rigid unit and stacked upon another racked bundle, in order to disengage the pick-up unit 40 from the racked bundle, the spring bolts 61 are disengaged from the arms 52 by pulling the spring-bolt levers inwardly. Then, the locking levers 57 are rotated downwardly as shown by arrows 63 in FIG. 11 while the bolts 61 are held in a retracted position. This immediately causes the counterbalance blocks 56 to rotate the lower ends of the arms outwardly free of the anchor pins 21. Then the pick-up unit may be lifted and moved to another location for reuse.

As a safety feature, in order to protect against failure to tighten down the retaining screws 44 which adjust the working length of the boom assembly 41, a metal cable 64 is secured between suitable anchors 65 on the yoke and 66 on the flat metal bar 45 attached to the center beam 42. In this fashion even in the event of a failure to suitably lock the beam assembly together, the yoke will not become separated from the beam.

It must be appreciated that the present beam assembly permits not only adjustment for the longitudinal spacing between racks, but also permits for the easy pick up of off balance loads. Thus by moving one beam extension 43 outwardly a different distance than the other extension 43, the central aperture 46 in the bar 45, to which a hoist is attached, is off center to correspond to the balance point for off center loads.

In addition, the arms of the pick-up unit are positively locked in their rack engaging position not only by the spring-loaded bolts 61 but also by the camming action between the locking levers 57 and the arms 52. Furthermore, deliberate disengagement of the levers 57 and the spring-loaded bolts 61 automatically disengages the fingers of the arms from the rack to facilitate removal of the pick-up assembly from a racked bundle.

After storage of a racked bundle and once the bundle is to be used, the pick-up unit 40 may be utilized to again transport an individual bundled rack to a desired location in the factory. Then, with the pick-up unit removed, the strapping band 25 may be cut and the individual components 10 removed one by one from the bundle. Thereafter, since the racks are now empty, they may be transported back for reuse in assembling new bundles of components.

Where the extrusions or components are sufficiently fragile, it may be desirable to use a conventional padding strip such as a corrugated cardboard between the engaging surfaces of the bundle and the rack and the band 25.

Having fully described an operative embodiment of the present invention, what is claimed is:

1. A pick-up unit for transporting bundles of elongated components or the like, the components being secured to a pair of spaced apart racks, the pick-up unit comprising:

an elongated beam of adjustable working length;

fastener means for securing the working length of the beam at a length substantially equal to the distance between the spaced apart racks; and a pair of rack-engaging units each secured to one end of the elongated beam so that upon positioning the pick-up unit over a racked bundle, each rack-engaging unit is aligned above a rack;

each rack engaging unit including: an elongated yoke secured to one end of the beam and mounted transversely thereof;

a pair of arms each having upper and lower ends and pivotally mounted at one end of said yoke intermediate its upper and lower ends;

each arm counterbalanced so that the lower end of each arm is normally in a non-rack engaging position solely by the influence of gravity; and locking means cooperating with the upper end of each arm for pivoting each arm so that the lower end engages a rack and so that the upper end of each arm is positively locked against pivoting.

2. The construction as defined in claim 1, wherein said elongated beam includes:

an elongated first beam, and at least one additional beam longitudinally telescopically mounted relative to said first beam, said fastener means for securing together said first beam and said additional beam at the desired working length.

3. The construction as defined in claim 1, wherein said elongated beam includes an elongated hollow first beam, and a pair of elongated hollow beams each telescopically mounted relative to said first beam, said pair of hollow beams being mounted at opposite ends of said first beam.

4. The construction as defined in claim 1, wherein said beam includes an elongated flat bar secured thereto, said bar having an aperture to receive a hook from a lift hoist or the like, and a safety cable interconnecting said flat bar and at least one of said rack-engaging units.

5. The construction as defined in claim 1, wherein said locking means includes a lever pivotally mounted to said yoke, said lever operating as a cam against said arm to pivot said arm into engagement with the leg of a rack, said lever also having a position disengaged from said arm.

6. The construction as defined in claim 5, wherein said locking means further includes a spring-loaded toward said arm to engage an aperture in said arm for locking said arm in a rack-engaging position.

7. A rack for transporting and storing a bundle of elongated, extrusion-like components, comprising:

a U-shaped frame formed of a base and two upwardly extending spaced apart legs secured to the opposite ends of the base for receiving a bundle of stacked elongated components arranged transversely of the frame;

an elongated vertical slot formed in each leg near the upper end thereof; and first anchor means formed on each leg near the lower end of its slot whereby a flexible strapping band may be arranged over the top of the bundle and span the space between the legs and extend through the slots and engage with the anchor means for tightly securing the bundle within the frame provided that the height of the bundle above the frame base is greater than the height of the lower end of the slot above the base; and second anchor means formed on each leg near the upper end of its slot whereby the frame and its received bundle may be lifted by engaging the first or second anchor means with a lifting hoist means.

8. A construction as defined in claim 7, wherein said legs are formed of vertically elongated channels, each channel having a base and integral flanges with the channels opening outwardly of the frame;

with the slots being formed in the bases of the channels and said anchor means each comprising a pin extending between and with its opposite ends secured to the flanges of the channel, wherein the band may be arranged around the pins for anchoring the bands to the frame and wherein the frame and its received bundle may be lifted by engaging the pins with a lifting hoist means.

9. A construction as defined in claim 8, wherein each of said leg-forming channels is slightly tapered from bottom to top so that its flange portions at its upper end are closer together than its flange portions at its lower end, wherein another rack of the same construction may be stacked upon the first-mentioned rack with the upper ends of the legs of one rack fitting within the lower end of the rack next above it.

10. A construction as defined in claim 9, and said rack base being formed of a downwardly opening channel extending the full width of the rack so that the upper ends of the legs of one rack fit into the base-forming channel and engage the base thereof of the rack next above it; and means closing off the opposite ends of the base-forming channel to prevent relative sideways movement of stacked racks.

11. A construction as defined in claim 9, and including a second rack, identical to but spaced apart from the first rack, to form a pair of racks for receiving and holding each bundle.

12. A system for storing and transporting a bundle of elongated extrusion-like components comprising in combination:

a pair of racks for transporting and storing a bundle of elongated, extrusion-like components;

each rack having a U-shaped frame formed of a base and two upwardly extending spaced apart legs secured to the opposite ends of the base for receiving a bundle of stacked elongated components arranged transversely of the frame;

an elongated vertical slot formed in each leg near the upper end thereof; and first anchor means formed on each leg whereby a flexible strapping band may be arranged over the top of the bundle and span the space between the legs and extend through the slots and engage with the anchor means for tightly securing the bundle within the frame provided that the height of the bundle above the frame base is greater than the height of the lower end of the slot above the base;

second anchor means formed on each leg near the upper end of its slot whereby the frame and its bundle may be lifted by engaging the first or second anchor means with a lifting hoist means;

an elongated beam of adjustable working length;

fastener means securing the working length of the beam at a length substantially equal to the distance between said racks;

a pair of rack-engaging units each secured to one end of the beam so that upon positioning the rack-engaging units over a racked bundle, each rack-engaging unit is aligned above a rack; and locking means for engaging each rack-engaging unit with the anchor means of its associated rack, each rack engaging unit including: an elongated yoke secured to one end of the beam and mounted transversely thereof;

a pair of arms each having upper and lower ends and pivotally mounted at one end of said yoke intermediate its upper and lower ends;

each arm counterbalanced so that the lower end of each arm is normaly in a non-rack engaging position solely by the influence of gravity; and locking means cooperating with the upper end of each arm for pivoting each arm so that the lower end engages a rack and so that the upper end of each arm is positively locked against pivoting.

* * * * *